US005429562A

United States Patent [19]

Milner

[11] Patent Number: 5,429,562

[45] Date of Patent: Jul. 4, 1995

[54] MECHANICAL SURFING APPARATUS

[75] Inventor: Graham Milner, Manchester, United Kingdom

[73] Assignee: Surftek International Inc., Fairfax, Va.

[21] Appl. No.: 220,597

[22] Filed: Mar. 31, 1994

[51] Int. Cl.[6] ..... A63B 22/16

[52] U.S. Cl. ..... 482/51; 482/71; 482/142; 482/146

[58] Field of Search ..... 482/51, 71, 142, 146, 482/79; 601/26; 472/59, 130

[56] References Cited

U.S. PATENT DOCUMENTS

| | | | |
|---|---|---|---|
| 1,100,725 | 6/1914 | Gibson | 472/59 |
| 1,671,096 | 5/1928 | Anderson | 482/79 |
| 3,610,610 | 10/1971 | Chassacine | 482/121 |
| 3,765,407 | 10/1973 | Prince | 601/26 |
| 4,749,180 | 6/1988 | Boomer . | |
| 5,002,272 | 3/1991 | Hofmeister | 482/146 |
| 5,009,412 | 4/1991 | Roodenbury et al. | 472/59 |

*Primary Examiner*—Richard J. Apley
*Assistant Examiner*—Lynne A. Reichard
*Attorney, Agent, or Firm*—Leydig, Voit & Mayer

[57] ABSTRACT

A mechanical surfing apparatus includes a board on which a rider can stand and a drive mechanism for cyclically varying the slope of the board to simulate the motions of a surfboard in waves. The board is supported at three support points spaced in the longitudinal direction of the board. Drive forces having differing frequencies are imparted to the board at two of the support points.

21 Claims, 2 Drawing Sheets

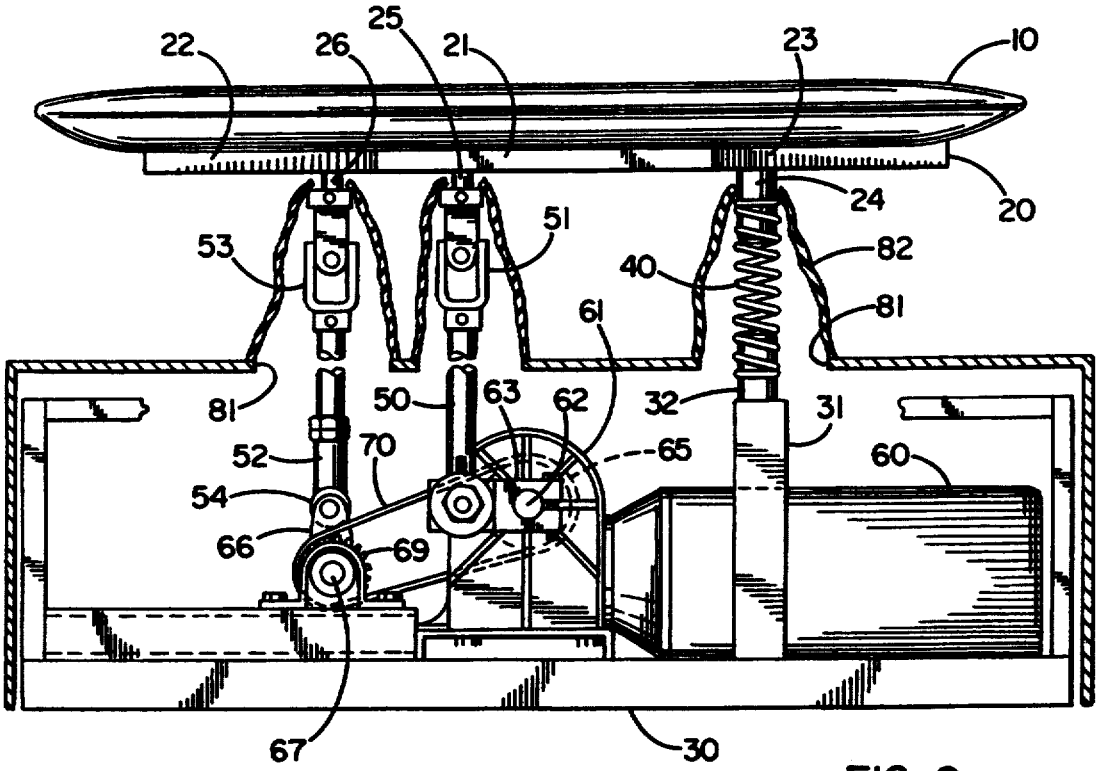
FIG. 2
FIG. 4
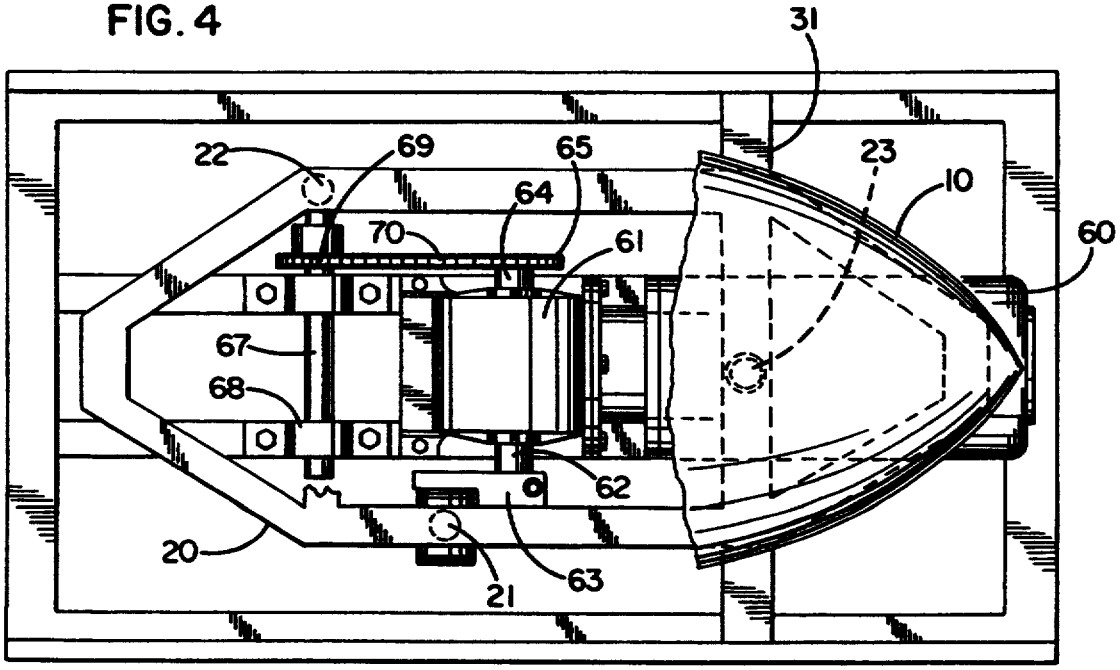

MECHANICAL SURFING APPARATUS

BACKGROUND OF THE INVENTION

This invention relates to a mechanical surfing apparatus and, more particularly, to a mechanical surfing apparatus that can produce widely varying motions.

A mechanical surfing apparatus simulates the motions of an actual surfboard in ocean waves. It typically includes a board in the shape of a surfboard on which a rider stands and a drive mechanism imparting oscillatory motion to the board. A mechanical surfing apparatus can be used not only as an amusement device but can conceivably be used as a training device for persons desiring to learn the sport of surfing.

Known mechanical surfing apparatus produce a motion which is highly repetitious, i.e., the motions of the board are repeated at short intervals. Therefore, to provide greater realism, it is desirable to produce a mechanical surfing apparatus that closely simulates the essentially random motions of a surfboard in the ocean.

SUMMARY OF THE INVENTION

Accordingly, it is an object of the present invention to provide a mechanical surfing apparatus that closely simulates the ride provided by an actual surfboard in ocean waves.

It is another object of the present invention to provide a mechanical surfing apparatus that can be operated either on land or in water, such as in a swimming pool.

A mechanical surfing apparatus according to one form of the present invention includes a support surface for supporting a standing human rider. A first drive member supports the support surface at a first support point, and a second drive member supports the support surface at a second support point. A drive mechanism is drivingly connected to the first and second drive members for cyclically imparting drive forces to the support points at differing first and second frequencies, respectively. In a preferred embodiment, the frequencies are not integral multiples of each other, so that the phase difference between the drive forces is constantly varying. As a result, the pattern of movement of the support surface is highly varied and provides a ride that more closely imitates the movements of an actual surfboard than can conventional mechanical surfing apparatus.

Preferably, the first and second support points are longitudinally spaced from each other on opposite lateral sides of a centerline of the support surface. The support surface may also be supported at a third support point longitudinally spaced from the first and second support points.

The support surface can be any surface on which a rider can stand but preferably has the shape of a surfboard.

BRIEF DESCRIPTION OF THE DRAWINGS

FIG. 2 is a side elevation view of the embodiment of FIG. 1.

FIG. 4 is a plan view of the embodiment of FIG. 1.

DESCRIPTION OF PREFERRED EMBODIMENTS

Figure 1:
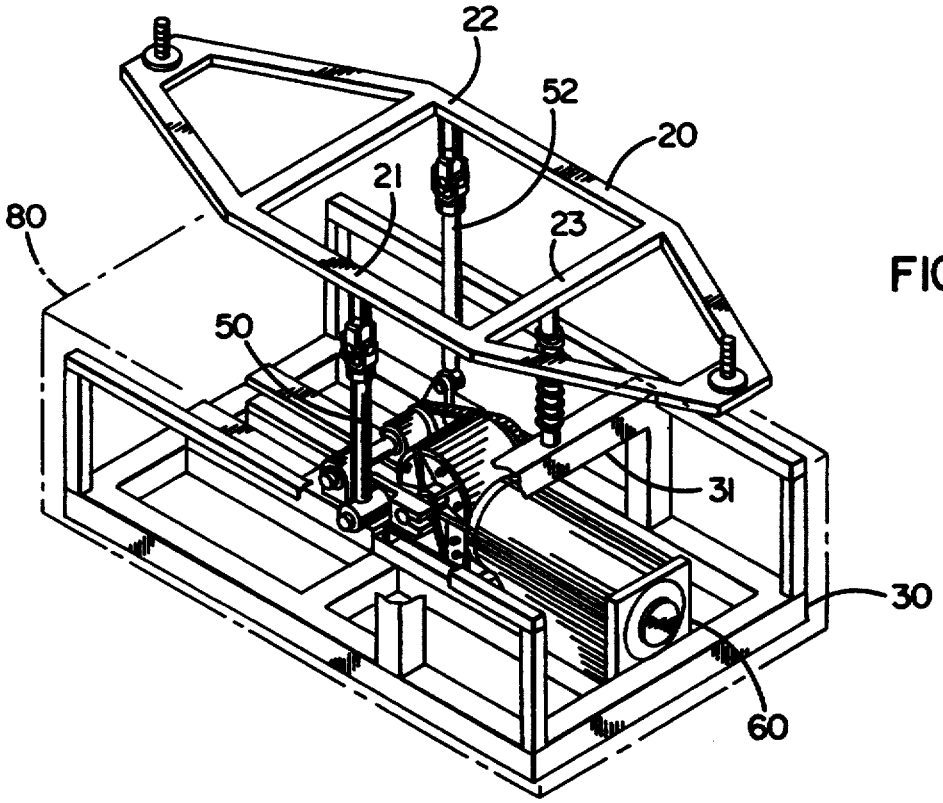
FIG. 1 is a perspective view of an embodiment of a mechanical surfing apparatus according to the present invention.

A preferred embodiment of a mechanical surfing apparatus according to the present invention shown in the drawings includes a support surface in the form of a generally flat board 10 on which a rider stands during operation of the apparatus. The shape of the board 10 is not critical, but preferably it has the shape of an actual surfboard to give greater realism to the apparatus. The board 10 may in fact be a genuine surfboard. Many surfboards for use in the ocean have an outer surface made of a hard, rigid material, such as fiber glass. However, to reduce the possibility of injury to a rider who might strike himself against the board 10, the board 10 may have an outer surface made of a resilient, relatively soft material, such as rubber or a closed cell foam of a polymer, such as polyethylene or polystyrene. Such surfboards are readily available and can easily be adapted for use in the present invention. Non-skid tape or a similar material can be attached to the top surface of the board 10 to make it easier for a rider to stand on the board 10.

Figure 3:
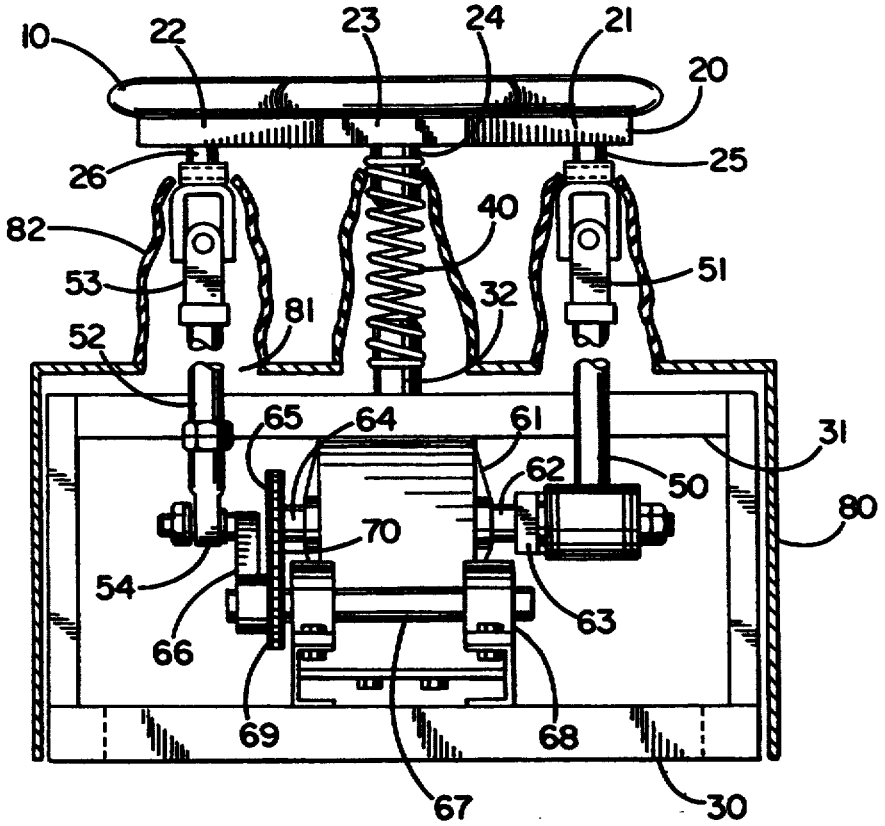
FIG. 3 is a front elevation view of the embodiment of FIG. 1.

The board 10 is detachably secured to a rigid frame 20 by suitable means, such as by bolts or clamps. The board 10 and the frame 20 are supported at first through third support points 21–23 which are spaced from one another in the longitudinal direction of the board 10. The first support point 21 is located on one side of the centerline of the board 10 (on the port side in this embodiment, i.e., the right side in FIG. 3) approximately half-way between the front and rear ends of the board 10. The second support point 22 is located on the opposite side of the centerline of the board 10 from the second first support point 21 (on the starboard side in this embodiment, i.e., the left side in FIG. 3) and forward of the first support point 21. The third support point 23 is located on or near the centerline of the board 10 approximately one third of the way from the rear end of the board 10 (the right end in FIG. 2). However, the exact locations of the support points are not critical and can be varied from the locations shown in the figures. For example, the first and second support points 21 and 22 could be the same distance from the front end of the board 10.

The third support point 23 is supported by a resilient support member, a helical compression spring 40, supported by a transverse frame 31 mounted on a base 30. The spring 40 can be connected between the frame 20 and the transverse frame 31 in any suitable manner. In this embodiment, a cylindrical stud 32 is rigidly secured to the upper surface of the transverse frame 31, and another cylindrical stud 24 is rigidly secured to the lower surface of frame 20. Each stud 24 and 32 has external threads corresponding to the pitch of the spring 40, and the spring 40 can be rigidly screwed onto the threads of the studs 24 and 32. If the vertical motions of the board 10 and frame 20 are small so that the spring 40 is unlikely to come loose from the studs, it is also possible to fit the spring 40 loosely over the studs 24 and 32.

The first and second support points 21 and 22 are connected to drive members in the form of first and second drive rods 50 and 52 which impart cyclic motions to the board 10. Preferably, the connection between the drive rods 50 and 52 and the frame 20 permits variation of the angles between them and, in this embodiment, the upper end of the drive rods 50 and 52 are equipped with respective universal joints 51 and 53 secured to stud 25 and 26, respectively, extending downward from the lower surface of the frame 20 at the first and second support points 21 and 22.

If the board 10 is sufficiently strong, the frame 20 can be omitted and the studs 24–26 can be mounted directly on the board 10. However, by employing a frame 20, a commercially available surfboard can be used as the board 10 with minimal modifications.

The drive rods 50 and 52 are driven by a drive mechanism including elements 60–70 and having a motor 60 and a reduction gear 61 mounted on the base 30. The motor 60 may be any suitable type, such as electric, hydraulic, or pneumatic. If the apparatus is to be disposed in a body of water, such as a swimming pool, a hydraulic motor is particularly suitable for reasons of safety. Preferably, the speed of the motor 60 can be adjusted by an unillustrated controller. The reduction gear 61 may be omitted if the speed of the motor 60 is suitable for directly powering the drive rods 50 and 52.

The reduction gear 61 has first and second output shafts 62 and 64 extending from opposite sides. A crank 63 for driving the first drive rod 50 is secured to the first output shaft 62, and the lower end of the first drive rod 50 is rotatably mounted on the crank 63. As the first output shaft 62 rotates, the lower end of the first drive rod 50 moves in a circle centered on the axis of the first output shaft 62, and a cyclic drive force is applied to the first support point 21. A first sprocket 65 is secured to the second output shaft 64 for rotation therewith.

The lower end of the second drive rod 52 is pivotally connected to a crank 66 by a ball and socket joint 54, and the crank 66 is secured to a support shaft 67 which is rotatably supported by bearings 68 mounted on the base 30. A second sprocket 69 is secured to the support shaft 67 and is driven by a chain 70 passing around the first sprocket 65 and the second sprocket 69. When the second output shaft 64 rotates, the lower end of the second drive rod 52 moves in a circle centered on the axis of the support shaft 67, and a cyclic drive force is applied to the second support point 22.

Preferably, the frequency of the cyclic drive force applied by the first drive rod 50 at the first support point 21 is different from and not an integral multiple of the frequency of the cyclic drive force applied by the second drive rod 52 at the second support point 22 so that the phase difference between the two drive forces continuously changes. At some points in time, the drive forces will be in phase, and at other times, they will be 180 degrees out of phase. Therefore, in the present embodiment, the speeds of rotation of the first output shaft 62 and the support shaft 67 are different from and not integral multiples of each other. The difference in rotational speed between the first output shaft 62 and the support shaft 67 can be achieved in a variety of manners. For example, the reduction gear 61 can be structured such that the first and second output shafts 62 and 64 have different rotational speeds. Alternatively, the first and second sprockets 65 and 69 can have different diameters so that the rotational speed of the second output shaft 64 is different from the rotational speed of the support shaft 67.

The rotational speed of the first output shaft 62 can be either greater or less than the rotational speed of the support shaft 67. In the present embodiment, the first and second output shafts 62 and 64 have the same rotational speed, and diameters of the sprockets 65 and 69 are chosen so that the rotational speed of the support shaft 67 is approximately 1.1 times that of the first output shaft 62. Therefore, the lower end of the second drive rod 52 moves along a circular path at approximately 1.1 times the rotational speed of the lower end of the first drive rod 50.

Since the first output shaft 62 and the support shaft 67 have different rotational speeds that are not integral multiples of each other, the pattern of movement of the board 10 varies widely. While the movement of the board 10 does repeat itself, the period of repetition can be much longer than the period of rotation of either of shafts 62 and 67. Therefore, to a person standing on the board 10, the motions appear essentially random and give the rider a feeling of great authenticity. A rider can stand on the board 10 in the same manner as he would stand on an actual surfboard in the ocean.

Any arrangement capable of imparting drive forces of different frequencies to the first and second support points 21 and 22 can be employed. For example, instead of using a single motor 60, separate motors operating at different speeds can be provided for the two drive rods 50 and 52. Alternatively, if the first and second output shafts 62 and 64 have different rotational speeds, the crank 66 connected to the second drive rod 52 can be mounted directly on the second output shaft 64 and the support shaft 67 can be eliminated. In addition, instead of the sprockets 65 and 69 and the chain 70, a gear train, a drive belt and pulleys, or another arrangement can be used to transmit rotational force from the second output shaft 64 to the support shaft 67.

The angle of slope of the board 10 with respect to the horizontal in the transverse direction will depend upon the rotational positions of the two cranks 63 and 66 and the lengths of the two drive rods 50 and 52. For example, the lengths of the drive rods can be selected such that during operation of the apparatus, the maximum angle of slope of the board 10 is greater to port than to starboard, greater to starboard than to port, or the same in either direction. The drive rods 50 and 52 may be variable in length so that the maximum angle of slope of the board 10 can be varied by altering the length of one or both of the drive rods.

The angle of slope of the board 10 in the longitudinal direction is similarly determined by the lengths of the cranks 63 and 66, the lengths of the drive rods 50 and 52, and the height of the spring 40 supporting the board 10 at the third support point 23. For example, the lengths of the drive rods 50 and 52 can be selected so that the board 10 never slopes backward or so that the board 10 can slope both forward and backward depending upon the rotational positions of the cranks 63 and 66.

In order to make the apparatus portable, retractable wheels can be installed on the bottom of the base 30. During operation of the apparatus, the base 30 may be subjected to vibrations. In order to prevent the base 30 from damaging a surface on which it is mounted, such as the bottom of a swimming pool, vibration absorbing members made of a resilient material may be installed on the bottom of the base 30.

The apparatus may be operated on either land or in water. When used on land, it may be surrounded by an inflatable mat or similar protective surface to prevent injury to riders who fall off the board 10. When the apparatus is installed in a body of water, such as a swimming pool, the top surface of the board 10 is preferably somewhat above the water level and the bottom surface is somewhat (such as 1 to 2 inches) below the water level when the board 10 is at its lowest position, i.e., when both cranks 63 and 66 are at bottom dead center. The motions of the board 10 itself are the same regardless of the location of the board 10 with respect to the water surface. However, if the lower surface of the board 10 is somewhat below the water level when the board 10 is at its lowest position, the up and down motion of the board 10 as the cranks 63 and 66 rotate will create waves and splashing as the bottom surface of the board 10 strikes the water surface, greatly increasing the realism of a ride on the apparatus. The direction of rotation of the cranks 63 and 66 is not critical and can be either clockwise or counter-clockwise.

The apparatus may be equipped with a cover to protect the mechanical parts of the apparatus as well as to provide a surface on which a rider can stand when mounting the apparatus. The illustrated embodiment has a removable cover 80 detachably secured to the base 30 by screws or similar means. Openings 81 in the top surface of the cover 80, passing the drive rods 50 and 52 and the spring 40, and flexible protective boots 82 surround each of the drive rods 50 and 52 and the spring 40 to prevent persons from being injured by the moving parts as well as to keep out dust and moisture. Instead of the protective boots 82, a flexible curtain can be hung downward from the frame 20 around its entire periphery. A flexible plastic mesh such as used for fencing in construction areas is particularly suitable for the curtain because air and water can freely pass through it.

When the apparatus is being used in water, the sides of the cover 80 may be sloped so that there are no sharp corners against which a rider can fall. Ladder rungs or steps can also be formed on the outside surface of the cover 80 to make it easier for a rider to mount the board 10.

I claim:

1. A mechanical surfing apparatus comprising:

a support surface for supporting a standing human rider, the support surface being substantially flat and having, a width, a length longer than the width, rounded ends, and a longitudinal centerline;

a first drive member supporting the support surface at a first support point;

a second drive member supporting the support surface at a second support point, the first and second support points being disposed on opposite sides of the longitudinal centerline and longitudinally spaced from each other;

a resilient support resiliently supporting the support surface at a third support point disposed on the longitudinal centerline of the support surface and longitudinally spaced from the first and second support points; and a drive mechanism drivingly connected to the first and second members for simultaneously imparting cyclic drive forces to the support points at differing first and second frequencies, respectively.

2. The surfing apparatus according to claim 1 wherein the drive mechanism includes first and second rotating cranks drivingly connected to the first and second drive members, respectively.

3. The surfing apparatus of claim 2 wherein the drive mechanism includes a motor having a shaft, a pulley, and an endless belt engaging the pulley wherein the first crank is directly connected to the shaft and the second crank is coupled to the shaft through the belt and pulley.

4. The surfing apparatus according to claim 1 wherein each drive member includes a universal joint supporting the support surface at the corresponding support point.

5. The surfing apparatus according to claim 1 wherein the resilient support comprises a spring.

6. The surfing apparatus according to claim 5 wherein the spring passively supports the support surface.

7. The surfing apparatus according to claim 5 wherein the spring comprises a helical compression spring.

8. The surfing apparatus according to claim 1 wherein the support surface has a resilient outer surface.

9. The surfing apparatus according to claim 8 wherein the support surface has an outer surface made of a closed cell polymeric foam.

10. The surfing apparatus according to claim 1 wherein the support surface comprises a surfboard.

11. The surfing apparatus according to claim 1 wherein one of the first and second drive members has an adjustable length.

12. A mechanical surfing apparatus comprising:

a support surface having a width, a length longer than the width, rounded ends, and a substantially flat surface for supporting a standing human rider, the support surface having a longitudinal centerline;

a first drive member including a first flexible joint supporting the support surface at a first support point on one side of the longitudinal centerline;

a second drive member including a second flexible joint supporting the support surface at a second support point longitudinally spaced from the first support point and disposed on an opposite side of the longitudinal centerline from the first support point;

a spring resiliently supporting the support surface at a third support point on the longitudinal centerline and longitudinally spaced from the first and second support points; and a drive mechanism comprising a first crank drivingly connected to the first drive member, a second crank drivingly connected to the second drive member, and a motor coupled to the cranks for simultaneously rotating the first and second cranks at different, respective first and second frequencies.

13. The surfing apparatus of claim 12 wherein the first and second flexible joints are universal joints.

14. The surfing apparatus according to claim 12 wherein the support surface comprises a surfboard.

15. The surfing apparatus according to claim 14 wherein the spring comprises a helical compression spring.

16. The surfing apparatus according to claim 12 wherein the spring passively supports the support surface.

17. The surfing apparatus according to claim 12 including first and second drive rods respectively connecting the first and second cranks with the first and second flexible joints.

18. The surfing apparatus according to claim 17 wherein the first and second drive rods have respective lengths so that the support surface tilts about the centerline as the first and second cranks rotate, a maximum angle of tilt of the support surface with respect to the horizontal in a first rotational direction of the support surface being greater than a maximum angle of tilt of the support surface in a second rotational direction, opposite the first rotational direction, of the support surface.

19. The surfing apparatus according to claim 18 wherein the first and second frequencies are not integer multiples of each other.

20. The surfing apparatus according to claim 12 wherein the first and second frequencies are not integer multiples of each other.

21. The surfing apparatus of claim 12 wherein the motor has a shaft and including a pulley mounted on the shaft and an endless belt engaging the pulley wherein the first crank is directly connected to the shaft and the second crank is coupled to the shaft through the belt and pulley.

* * * * *